US007223083B2

(12) United States Patent
Kim et al.

(10) Patent No.: US 7,223,083 B2
(45) Date of Patent: May 29, 2007

(54) SCROLL COMPRESSOR

(75) Inventors: Myung-Kyun Kim, Incheon (KR); Byeong-Chul Lee, Seoul (KR); Dong-Won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 133 days.

(21) Appl. No.: 11/034,742

(22) Filed: Jan. 14, 2005

(65) Prior Publication Data

US 2006/0083648 A1 Apr. 20, 2006

(30) Foreign Application Priority Data

Oct. 16, 2004 (KR) ..... 10-2004-0082929

(51) Int. Cl.
*F03C 2/00* (2006.01)
*F04C 18/00* (2006.01)

(52) U.S. Cl. ..... 418/55.3; 418/55.1; 418/60

(58) Field of Classification Search ..... 418/55.1–55.6, 418/57–60

See application file for complete search history.

(56) References Cited

U.S. PATENT DOCUMENTS 4,650,405 A * 3/1987 Iwanami et al. ..... 418/55.1

FOREIGN PATENT DOCUMENTS

| | | | |
|---|---|---|---|
| JP | 62067288 A | * | 3/1987 |
| KR | 20-0143515 | | 6/1999 |
| KR | 1020040007984 A | | 1/2004 |

* cited by examiner

*Primary Examiner*—Theresa Trieu
(74) *Attorney, Agent, or Firm*—Birch, Stewart, Kolasch & Birch LLP

(57) ABSTRACT

A scroll compressor is disclosed. In the scroll compressor, a first compression chamber is formed between an orbiting scroll and a fixed scroll, and a second compression chamber is additionally formed between the orbiting scroll and the main frame. Accordingly, when the orbiting scroll orbits, a refrigerant gas is compressed in both compression chambers at the same time, so that the scroll compressor can have a capacity greater than those of other compressors having the same size.

19 Claims, 9 Drawing Sheets

SCROLL COMPRESSOR

BACKGROUND OF THE INVENTION

1. Field of the Invention

The present invention relates to a scroll compressor, and particularly, to a scroll compressor capable of increasing a discharge capacity without a size change.

2. Description of the Conventional Art

In general, a compressor converts mechanical energy into compression energy of a compressible fluid, and may be classified into a reciprocating type, a scroll type, a centrifugal type and a vane type.

Unlike the reciprocating compressor using a linear movement of a piston, the scroll compressor sucks, compresses and discharges a gas by using a rotor as the centrifugal type or the vane type compressor.

Such a scroll compressor is commonly used for an air conditioner. To improve cooling and heating efficiency of the air conditioner, a scroll compressor which can vary its capacity has been recently required.

FIG. 1 is a longitudinal sectional view showing a conventional scroll compressor.

As shown, the conventional scroll compressor includes: a casing 1 provided with a gas suction pipe (SP) and a gas discharge pipe (DP); a main frame 2 and a sub frame (not shown) fixedly installed at upper and lower sides of the casing 1, respectively; a driving motor 3 mounted between the main frame 2 and the sub frame, for generating a rotary force; a rotary shaft 4 fixed at the center of the driving motor 3 and penetrating the center of the main frame 2 to transfer a rotary force of the driving motor 3; a fixed scroll 5 fixedly installed on an upper surface of the main frame 2; an orbiting scroll 6 put on an upper surface of the main frame 2 and orbiting in a state of being interlocked with the fixed scroll 5 to thereby form a compression chamber (P); a self-rotation preventing member 7 (Oldham's ring) installed between the orbiting scroll 6 and the main frame 2, for preventing self-rotation of the orbiting scroll 6; and a discharge cover 8 coupled to an upper surface of the fixed scroll, for dividing the inside of the casing 1 into a low pressure portion (S1) and a high pressure portion (S2).

Generally, the fixed scroll 5 fixed at an upper portion of the main frame 2 and the orbiting scroll 6 rotatably installed between the fixed scroll 5 and the main frame 2 are referred to as a compression unit.

A boss receiving portion 2*b* for an orbiting movement of a boss portion 6*b* of the orbiting scroll 6 is formed at a central portion of the main frame 2, and a shaft hole 2*a* for supporting the rotary shaft 4 is formed at the center of the boss receiving portion 2*b*.

A wrap 5*a* forming a compression chamber (P) by being interlocked with a wrap 6*a* of the orbiting scroll 6 to be explained later is formed at a lower surface of the fixed scroll 5 as an involute shape, and a suction hole 5*b* is formed at an outermost edge of the wrap 5*a*. A discharge hole 5*c* communicating with the high pressure portion (S2) of the casing 1 is formed near the central portion of the fixed scroll 5.

A wrap 6*a* is formed at an upper surface of the orbiting scroll 6 as an involute shape and is interlocked with the wrap 5*a* of the fixed scroll 5. A boss portion 6*b* coupled to an eccentric portion 4*a* of the rotary shaft 4 and orbiting within the boss receiving portion 2*b* of the main frame 2 is formed at a central portion of a lower surface of the orbiting scroll.

The conventional scroll compressor having such a structure is operated in the following manner.

When the rotary shaft 4 of the driving motor 3 rotates by applied power, the orbiting scroll 6 does not rotate but orbits by the self-rotation preventing member 7.

At this time, a compression chamber (P) is formed between the wrap 6*a* of the orbiting scroll 6 and the wrap 5*a* of the fixed scroll 5. By a constant orbiting movement of the orbiting scroll 6, the compression chamber (P) moves a refrigerant gas, which has been introduced from the suction hole 5*b*, toward the discharge hole 5*c*, and then discharges the gas.

In other words, the refrigerant gas is sucked into the low pressure portion (S1) of the casing 1 through the gas suction pipe (SP), is introduced toward an outermost edge of the compression chamber (P) through the suction hole 5*b* of the fixed scroll 5, and then is compressed, gradually moving toward the inside of the compression chamber (P) by a continuous orbiting movement of the orbiting scroll 6. The compressor refrigerant gas is discharged to the high pressure portion (S2) of the casing 1 through the discharge hole 5*c* of the fixed scroll 5.

However, the conventional scroll compressor having such a structure has a limit in increasing its capacity because the refrigerant gas is compressed only in the compression chamber (P) formed by the orbiting scroll 6 and the fixed scroll 5.

SUMMARY OF THE INVENTION

Therefore, an object of the present invention is to provide a scroll compressor capable of increasing a capacity while maintaining the size of the compressor.

To achieve these and other advantages and in accordance with the purpose of the present invention, as embodied and broadly described herein, there is provided a scroll compressor comprising: a casing; a driving motor fixedly installed in the casing; a frame fixedly installed inside the casing, for supporting a rotary shaft of the driving motor, wherein a ring shaped partition wall protrudes from a bottom of a boss receiving portion formed at a central portion of the frame, a vane side suction hole is formed at one side of the bottom of the boss receiving portion outside the partition wall, and a pair of vane side discharge holes are formed at the other side of the bottom; a fixed scroll fixedly installed at the frame, and having a first suction hole at its outermost edge and a first discharge hole at its central portion; an orbiting scroll forming a first compression chamber by being interlocked with the fixed scroll, orbiting by rotation of the rotary shaft, and having a boss portion for insertion of the rotary shaft and an orbiting vane encompassing the boss portion, wherein the boss portion is formed at a central portion of a lower portion of the orbiting scroll and the orbiting vane is formed at an outer edge of the lower portion of the orbiting scroll at a certain interval from the boss portion; a self-rotation preventing member interposed between the frame and the orbiting scroll, for preventing self-rotation of the orbiting scroll and leading an orbiting movement; and a slide block positioned between the vane side suction hole and a pair of vane side discharge holes, inserted in the orbiting vane to be slidable in a radial direction of the frame, and forming a second compression chamber outside and inside the orbiting vane.

A slit is formed at the orbiting vane, and the slide block is slidably inserted in the slit.

The second compression chamber comprises an inner second compression chamber formed inside the orbiting vane and an outer second compression chamber formed outside the orbiting vane, and a pair of vane side discharge holes are an outer vane side discharge hole positioned outside the orbiting vane and an inner vane side discharge hole positioned inside the orbiting vane.

Preferably, a diameter of the vane side suction hole is greater than that of each vane side discharge hole.

The vane side suction hole is positioned extendedly on the inner second compression chamber and the outer second compression chamber, and the outer vane side discharge hole is positioned extendedly on the outer second compression chamber and the inner vane side discharge hole is positioned extendedly on the inner second compression chamber.

The vane side suction hole is connected to a low pressure portion of the casing, and the vane side discharge hole is connected to a high pressure portion of the casing.

Preferably, the slide block is installed to be in contact with an outer circumferential surface of the partition wall, and curved portions are formed at both sides of the slide block.

The boss portion is positioned at an outer circumferential surface of the rotary shaft centering on the rotary shaft, the partition wall is positioned at an outer edge of the boss portion, and the orbiting vane is positioned at an outer edge of the partition wall.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
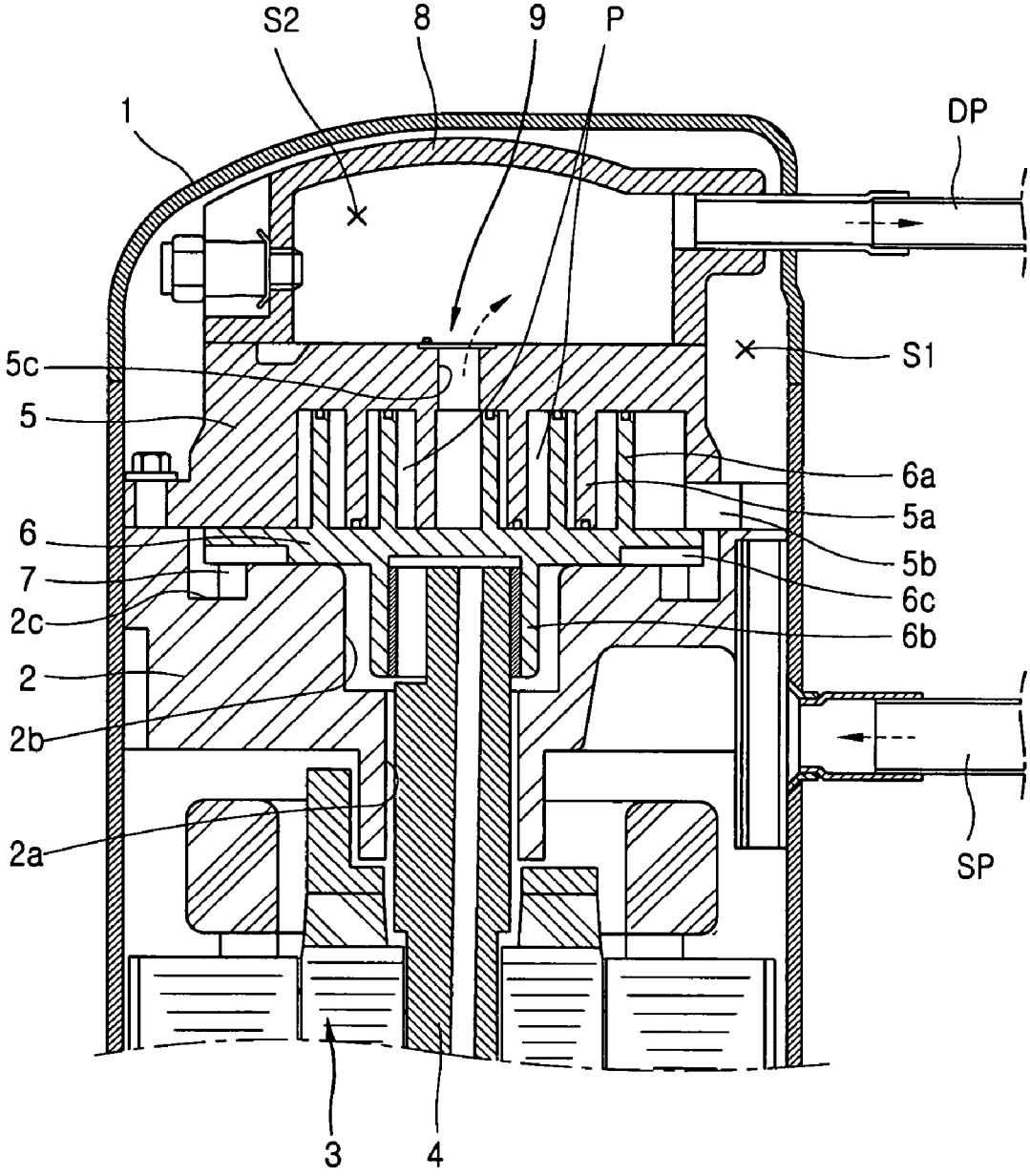
FIG. 1 CONVENTIONAL ART
FIG. 1 is a longitudinal sectional view showing a part of a conventional scroll compressor.
Figure 2:
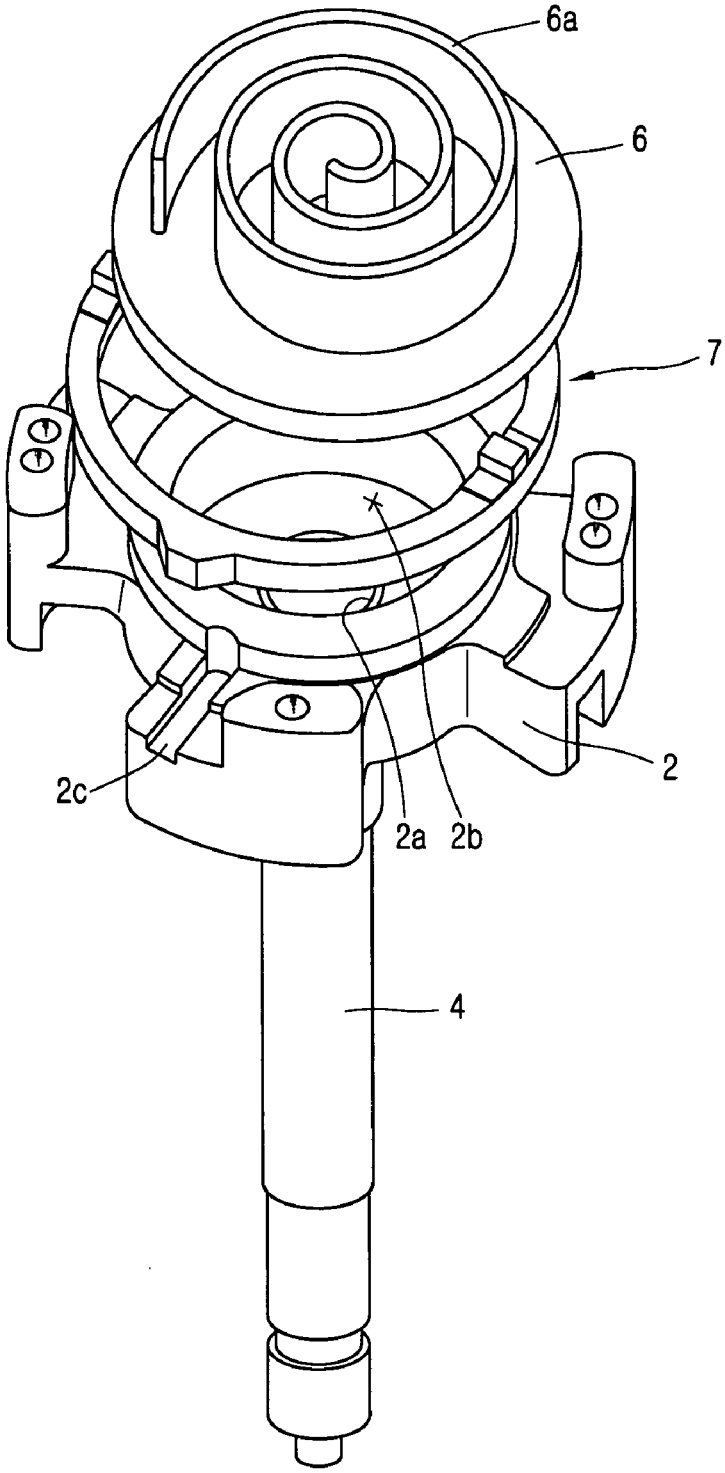
FIG. 2 CONVENTIONAL ART
FIG. 2 is an exploded perspective view showing a compression unit of the conventional scroll compressor.
Figure 3:
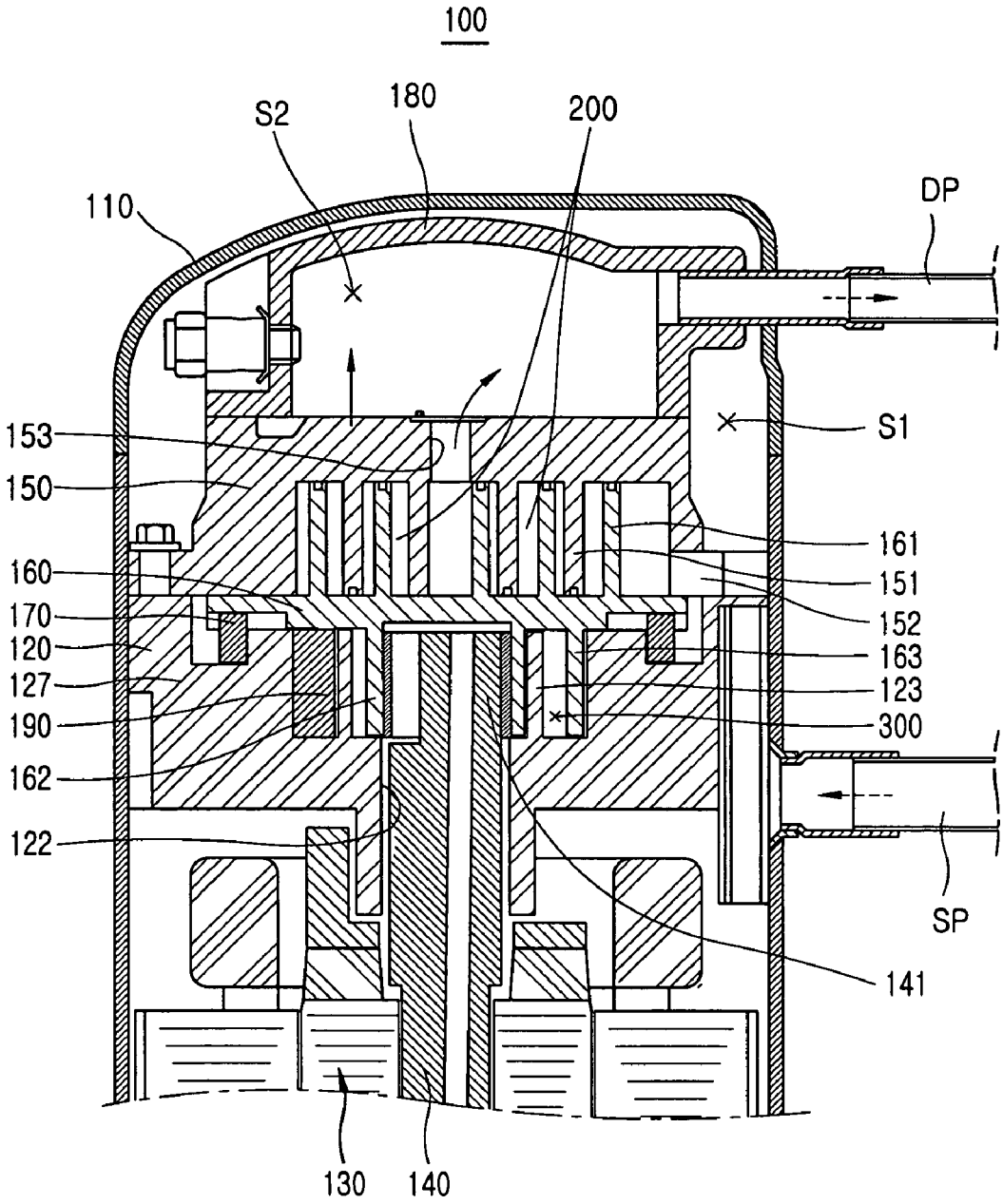
FIG. 3 is a longitudinal sectional view for describing a vane side suction hole of a scroll compressor in accordance with the present invention.
Figure 4:
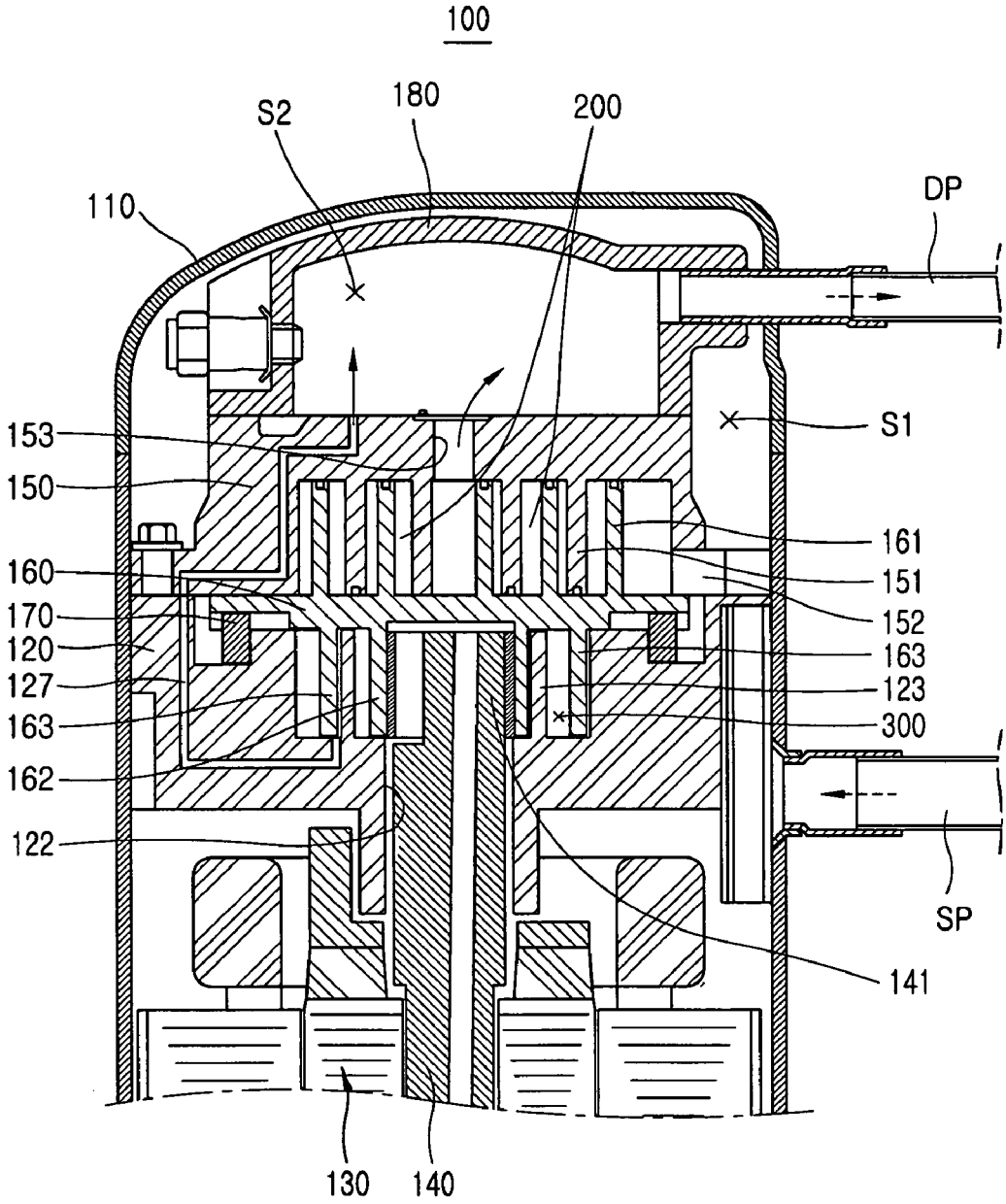
FIG. 4 is a longitudinal sectional view for describing a vane side discharge hole of the scroll compressor in accordance with the present invention.
Figure 5:
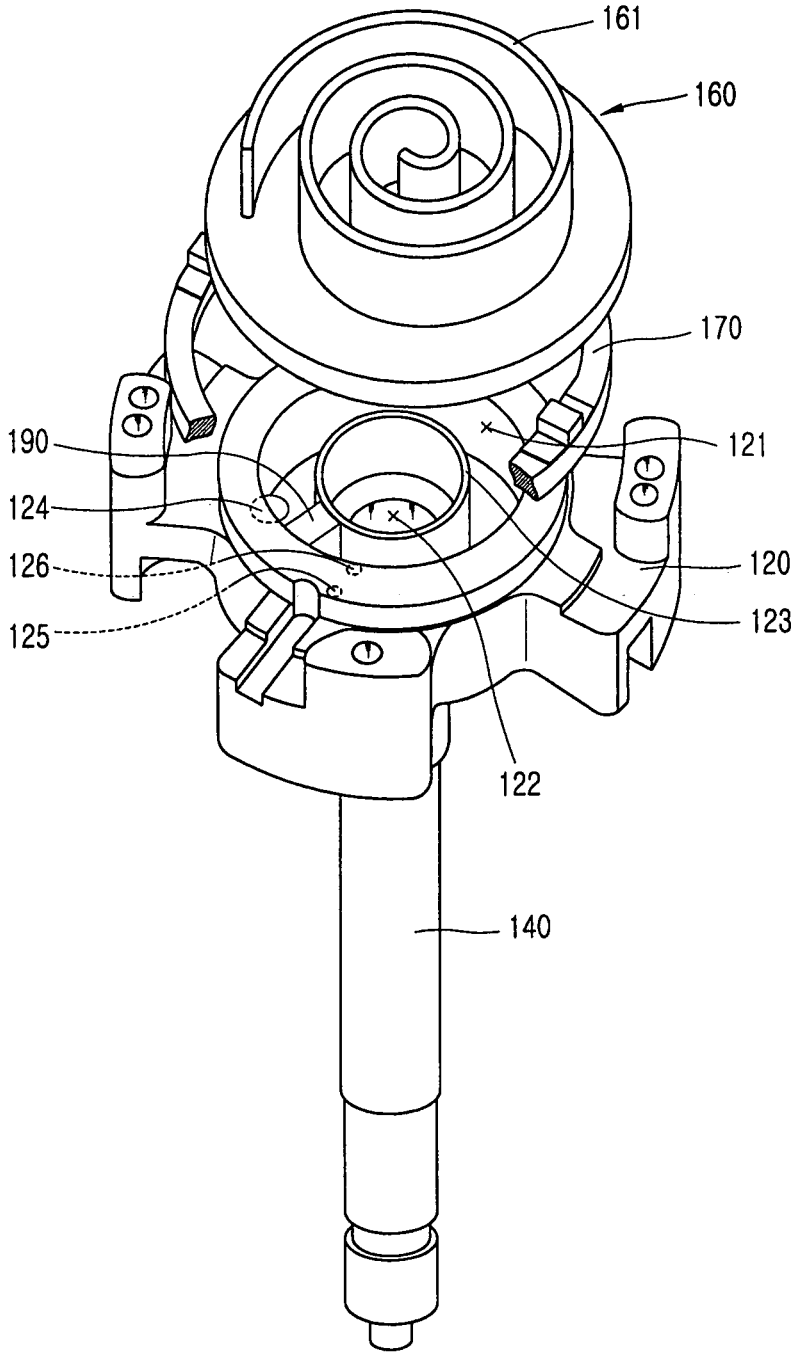
FIG. 5 is an exploded perspective view showing a compression unit of the scroll compressor in accordance with the present invention.
Figure 6:
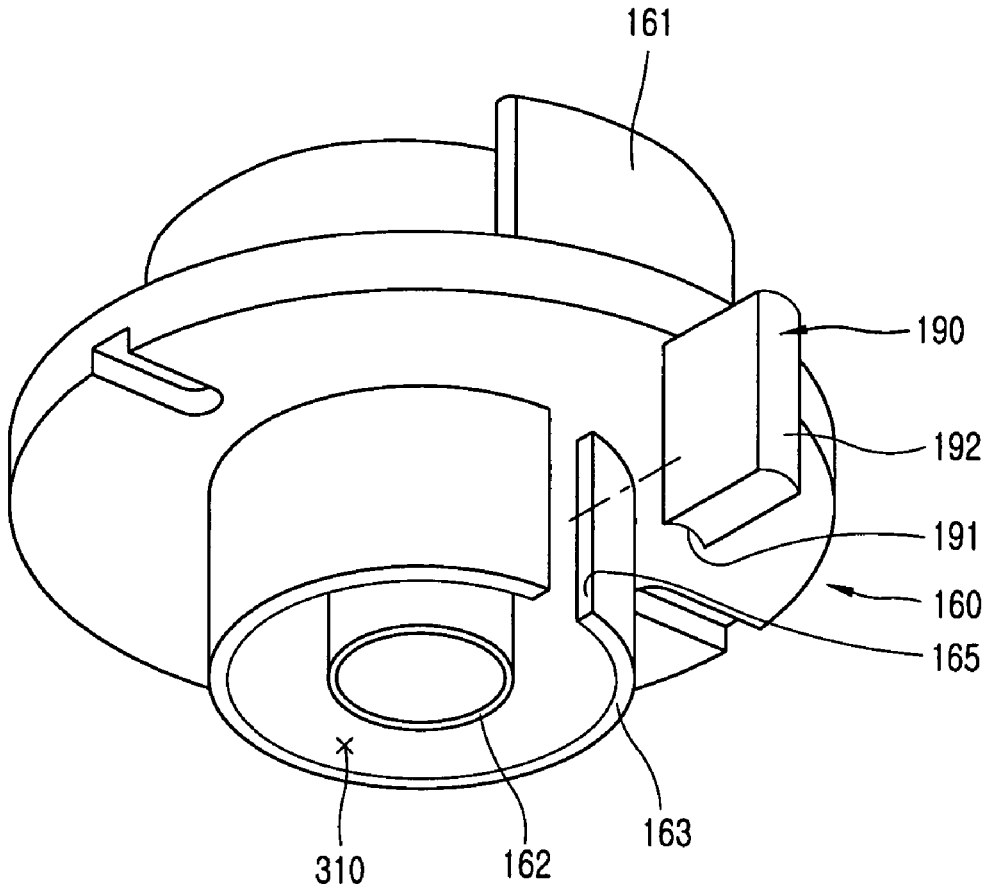
FIG. 6 is a bottom perspective view showing an orbiting scroll of the scroll compressor in accordance with the present invention.
Figure 7:
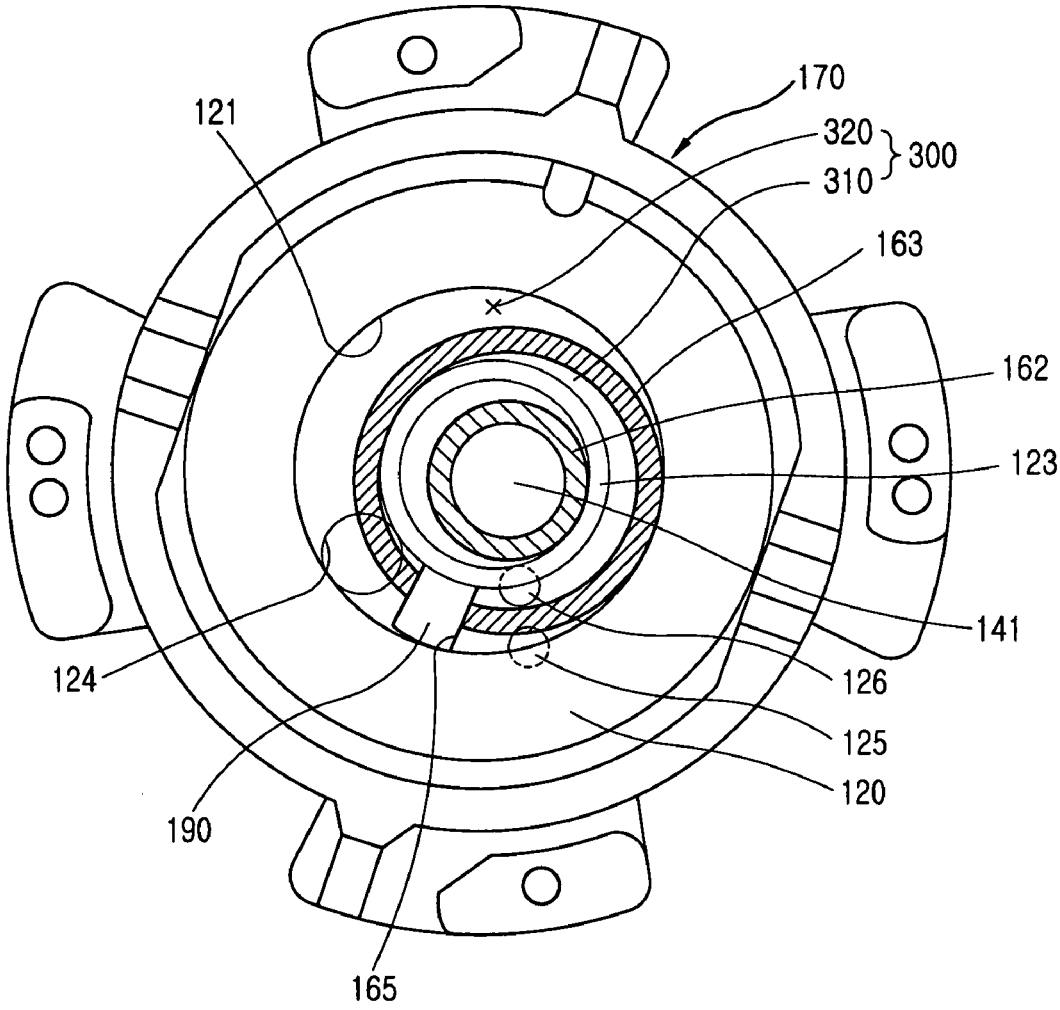
FIG. 7 is a cross-sectional view for describing a vane side compression unit of the scroll compressor in accordance with the present invention.

FIG. 3 is a longitudinal sectional view for describing a vane side suction hole of a scroll compressor in accordance with the present invention, FIG. 4 is a longitudinal sectional view for describing a vane side discharge hole of the scroll compressor in accordance with the present invention, FIG. 5 is an exploded perspective view showing a fixed scroll side compression unit o in accordance with the present invention, FIG. 6 is a bottom perspective view showing an orbiting scroll of the scroll compressor in accordance with the present invention, and FIG. 7 is a cross-sectional view for describing a vane side compression unit the scroll compressor in accordance with the present invention.

As shown, the scroll compressor 100 in accordance with the present invention includes: a casing 110 provided with a gas suction pipe (SP) and a gas discharge pipe (DP); a main frame 120 and a sub frame (not shown) fixedly installed at upper and lower sides of the casing 110, respectively; a driving motor 130 mounted between the main frame 120 and the sub frame, for generating a rotary force; a rotary shaft 140 fixed at the center of the driving motor 130 and penetrating the center of the main frame 120 to transfer a rotary force of the driving motor 130; a fixed scroll 150 fixedly installed on an upper surface of the main frame 120; an orbiting scroll 160 put on the upper surface of the main frame 120 and orbiting in a state of being interlocked with the fixed scroll 150 to thereby form a compression chamber 200; a self-rotation preventing member 170 (Oldham's ring) installed between the orbiting scroll 160 and the main frame 120, for preventing self-rotation of the orbiting scroll 160; and a discharge cover 180 coupled to an upper surface of the fixed scroll 150 and dividing the inside of the casing 110 into a low pressure portion (S1) and a high pressure portion (S2).

In the scroll compressor in accordance with the present invention, the main frame 120, the fixed scroll 150 fixed at an upper portion of the main frame 120, and the orbiting scroll 160 rotatably installed between the fixed scroll 150 and the main frame 120 are referred to as a fixed scroll side compression unit.

A partition wall 123 of the main frame 120, an orbiting vane 163 of the orbiting scroll 160 and a slide block 190 which are to be explained later are referred to as to a vane side compression unit.

A space for an orbiting movement of a boss portion 162 of the orbiting scroll 160, namely, a boss receiving portion 121 is formed at a central portion of the main frame 120, and a shaft hole 122 for supporting the rotary shaft 140 is formed at the center of the boss receiving portion 121.

A wrap 151 forming a first compression chamber 200 by being interlocked with a wrap 161 of the orbiting scroll 160 to be explained later is formed at a lower surface of the fixed scroll 150 as an involute shape, and a suction hole 152 is formed at an outermost edge of the wrap 151. A discharge hole 153 communicating with the high pressure portion (S2) of the casing 110 is formed near the center of the fixed scroll 150.

A wrap 161 is formed at an upper surface of the orbiting scroll 160 as an involute shape and is interlocked with the wrap 151 of the fixed scroll 150. A boss portion 162 coupled to an eccentric portion 141 of the rotary shaft 140 and orbiting within the boss receiving portion 121 of the main frame 120 is formed at a central portion of a lower surface of the orbiting scroll 160.

As for characteristics of the present invention, a partition wall 123 having a ring shape protrudes from a bottom of the boss receiving portion 121 of the frame 120, a vane side suction hole 124 is formed at one side of the bottom of the boss receiving portion 121 outside the partition wall 123, and a pair of vane side discharge holes 125 and 126 are formed at the other side of the bottom.

Also, an orbiting vane 163 is formed at a certain distance from the boss portion 162 of the orbiting scroll 160, surrounding the boss portion 162, and a slit 165 is formed at one side of the orbiting vane 163.

A slide block 190 is positioned between the vane side suction hole 124 and a pair of vane side discharge holes 125 and 126. The slide block 190 is inserted in the orbiting vane 163 to be slidable in a radial direction of the frame 120 and forms a second compression chamber 300 outside and inside the orbiting vane 163.

In other words, the second compression chamber 300 is a compression space formed between the orbiting vane 163 and the slide block 190 when the slide block 190 is inserted in the slit 165 comes in contact with an outer circumferential surface of the partition wall 123.

The second compression chamber 300 may be divided into an inner second compression chamber 310 formed inside the orbiting vane 163 and an outer second compression chamber 320 formed outside the orbiting vane 163.

Preferably, a curved portion 191 having the same curvature as that of the outer circumferential surface of the partition wall 123 is formed at one end of the slide block 190, so that the slide block 190 can be closely attached and contact with the outer circumferential surface of the partition wall 123. Also, a curved portion 192 having the same curvature as that of an inner circumferential surface of the boss receiving portion 121 is preferably formed at the other end of the slide block 190, so that the slide block 190 can be closely attached to the inner circumferential surface of the boss receiving portion 121.

Figure 8A:
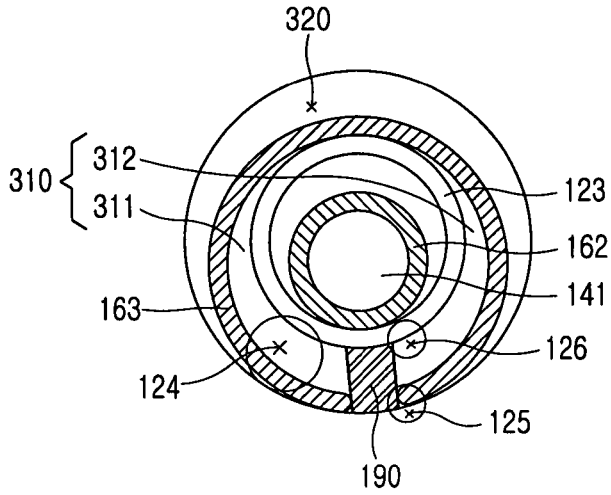
FIGS. 8A to 8D are cross-sectional views for describing the operation of the vane side compression unit.
Figure 8B:
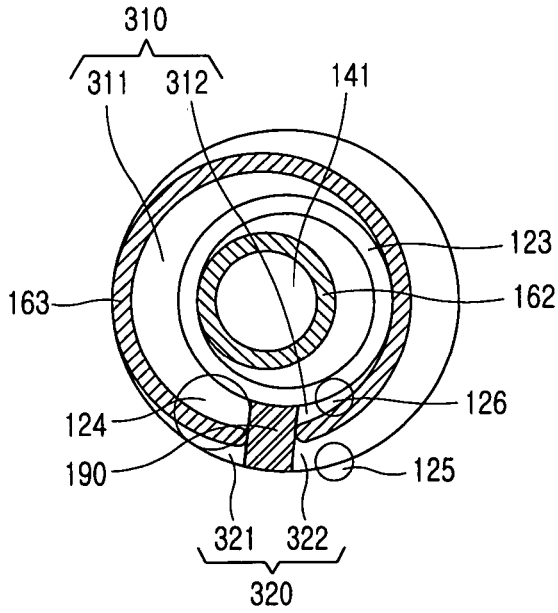
Figure 8C:
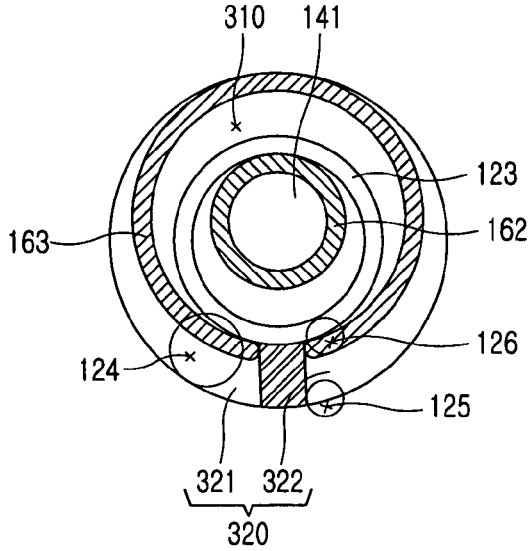
Figure 8D:
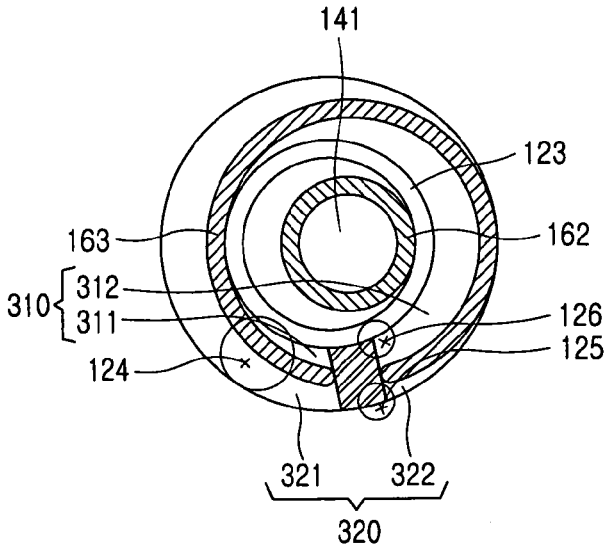

As shown in FIGS. 8A and 8D, for the purpose of simplicity, as the inner second compression chamber 310 is divided into two by the orbiting vane 163 and the slide block 190, one space of the inner second compression chamber 310 is referred to as a compression chamber 311, and the other space thereof is referred to as a compression chamber 312. Also, as the outer second compression chamber 320 is divided into two by the orbiting vane 163 and the slide block 190, one space of the outer second compression chamber 320 is referred to as a compression chamber 321 and the other space is referred to as a compression chamber 322.

A pair of vane side discharge holes 125 and 126 are an outer vane side discharge hole 125 positioned outside the orbiting vane 163 and an inner vane side discharge hole 126 positioned inside the orbiting vane 163.

A diameter of the vane side suction hole 124 is preferably greater than that of each vane side discharge hole 124, 125.

The vane side suction hole 124 is positioned extendedly on the inner second compression chamber 310 and the outer second compression chamber 320, the outer vane side discharge hole 125 is positioned extendedly on the outer second compression chamber 320, and the inner vane side discharge hole 126 is positioned extendedly on the inner second compression chamber 310.

As shown in FIG. 3, the vane side suction hole 124 is connected to the low pressure portion (S1) of the casing 110, and the vane side discharge holes 125 and 126 are connected to the high pressure portion (S2) of the casing 110.

Accordingly, the boss portion 162 is positioned at an outer circumferential surface of the rotary shaft 140 centering on the eccentric portion 141 of the rotary shaft 140, the partition wall 123 is positioned at an outer edge of the boss portion 162, and the orbiting vane 163 is positioned at an outer edge of the partition wall 123.

The operation of the scroll compressor in accordance with the present invention having such a structure will now be described.

Namely, when the driving motor 130 rotates the rotary shaft 140 upon receiving power, the orbiting scroll 160 orbits as long as an eccentric distance, thereby forming a first compression chamber 200 between the wrap 161 of the orbiting scroll 160 and the wrap 151 of the fixed scroll 150. The first compression chamber 200 consecutively moves toward the center by the constant orbiting movement of the orbiting scroll 160, thereby reducing its volume. In such a process, the refrigerant gas is sucked into the scroll side suction hole 151 from the low pressure portion (S1) of the casing 110, is gradually compressed, and then is discharged to the high pressure portion (S2) of the casing 110 through the scroll side discharge hole 153 of the fixed scroll 150.

Also, because of the orbiting vane 163 formed at a rear surface of the orbiting scroll 160, a lower surface, and the slide block 190 linearly moving in a radial direction, provided at the orbiting vane 163 and installed between the vane side suction hole 124 and each vane side discharge hole 125 and 126, an outer second compression chamber 320 and an inner second compression chamber 310 having a phase difference of 180 degrees are formed between an outer circumferential surface of the orbiting vane 163 of the orbiting scroll 160 and an inner circumferential surface of the boss receiving portion 121 of the main frame 120 and between an inner circumferential surface of the orbiting vane 163 and an outer circumferential surface of the partition wall 123 of the main frame 120, respectively.

The refrigerant gas is sucked through the vane side suction hole 124 in the casing 110, compressed, and then discharged through both vane side discharge holes 125 and 126. The refrigerant gas discharged from the second compression chamber is discharged to the gas discharge pipe (DP) through a gas passage 127, together with a refrigerant gas discharged from the first compression chamber 200. Therefore, the scroll compressor 100 in accordance with the present invention can raise its discharge capacity by discharging a refrigerant gas from not only the first compression chamber but also the second compression chamber.

FIGS. 8A to 8D are cross-sectional views for describing the operation of the vane side compression unit. Hereinafter, processes for suction, compression, discharge of a refrigerant gas in the second compression chamber will now be described with reference to FIGS. 8A to 8D.

First, as shown in FIG. 8A, at an initial stage, the vane side suction hole 124 communicates with a compression chamber 311 of the inner second compression chamber 311, so that a refrigerant gas is sucked only to the compression chamber 311 of the inner second compression chamber 310. At the same time, discharge of the refrigerant gas through the vane side discharge hole 126 is started in a compression chamber 312 of the inner second compression chamber 310, which is positioned on the opposite side of the compression chamber 311 on the basis of the slide block 190. Meanwhile, in the outer second compression chamber 320, suction of the refrigerant gas through the vane side suction hole 124 is completed, and compression is started.

Then, as shown in FIG. 8B, at a position of the orbiting vane 163 having orbited clockwise from the initial position as much as an angular distance of 90 degrees, a very small amount of a refrigerant gas is sucked to a compression chamber 321 of the outer second compression chamber 320 through the vane side suction hole 124, and simultaneously, compression of a refrigerant gas further proceeds in a compression chamber 322 of the outer second compression chamber 320, which is positioned on the opposite side of the compression chamber 321 on the basis of the slide block 190. Meanwhile, in the compression chamber 311 of the inner second compression chamber 310, a suction area gets wider and a refrigerant gas is sucked through the vane side suction hole 124. At the same time, compression of a refrigerant gas is completed in the compression chamber 312 of the inner second compression chamber 310.

Then, as shown in FIG. 8C, at a position of the orbiting vane 163 having further orbited clockwise at an angular distance of another 90 degrees, a refrigerant gas is sucked into the compression chamber 321 of the outer second compression chamber 320 through the vane side suction hole 124, and simultaneously, a refrigerant gas is discharged from the compression chamber 322 of the outer second compression chamber 320 through the vane side discharge hole 125. Meanwhile, in the inner second compression chamber 310, suction of a refrigerant gas through the vane side suction hole 124 is completed, and compression is started.

Next, as shown in FIG. 8D, at a position where the orbiting vane 163 having orbited at an angular distance of another 90 degrees, a refrigerant gas is continuously sucked into the compression chamber 321 of the outer second compression chamber 320 through the vane side suction hole 124, and simultaneously, the compression in the compression chamber 322 of the outer second compression chamber 320 is completed. Meanwhile, suction of the refrigerant gas into the compression chamber 311 of the inner second compression chamber 310 is started through the vane side suction hole 124. At the same time, compression is continued in the compression chamber 312 of the inner second compression chamber 310. A series of such processes of sucking, compressing and discharging of a refrigerant gas are repetitively carried out.

As described above, when the orbiting scroll 160 orbits, it forms the first compression chamber together with the fixed scroll 150 and also forms a second compression chamber 300 together with the main frame 120. Accordingly, a capacity of the compression can be greatly increased without enlarging a size of the compressor.

As so far described, the scroll compressor in accordance with the present invention, a first compression chamber is formed between the orbiting scroll and the fixed scroll, and a second compression chamber is additionally formed between the orbiting scroll and the main frame, so that a refrigerant gas can be compressed in both compression chambers while the orbiting scroll orbits, thereby obtaining a capacity greater than that of other compressors having the same size.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor comprising:

a casing;

a driving motor fixedly installed in the casing;

a frame fixedly installed inside the casing, for supporting a rotary shaft of the driving motor, wherein a ring shaped partition wall protrudes from a bottom of a boss receiving portion formed at a central portion of the frame, a vane side suction hole is formed at one side of the bottom of the boss receiving portion outside the partition wall, and a pair of vane side discharge holes are formed at the other side of the bottom;

a fixed scroll fixedly installed at the frame, and having a first suction hole at its outermost edge and a first discharge hole at its central portion;

an orbiting scroll forming a first compression chamber by being interlocked with the fixed scroll, orbiting by rotation of the rotary shaft, and having a boss portion for insertion of the rotary shaft, and an orbiting vane encompassing the boss portion, wherein the boss portion is formed at a central portion of a lower portion of the orbiting scroll and the orbiting vane is formed at an outer edge of the lower portion of the orbiting scroll at a certain interval from the boss portion;

a self-rotation preventing member interposed between the frame and the orbiting scroll, for preventing self-rotation of the orbiting scroll and leading an orbiting movement; and a slide block positioned between the vane side suction hole and the pair of vane side discharge holes, inserted in the orbiting vane to be slidable in a radial direction of the frame, and forming a second compression chamber outside and inside the orbiting vane.

2. The scroll compressor of claim 1, wherein a slit is formed at the orbiting vane, and the slide block is slidably inserted in the slit.

3. The scroll compressor of claim 2, wherein curved portions are formed at both sides of the slide block.

4. The scroll compressor of claim 1, wherein the second compression chamber comprises an inner second compression chamber formed inside the orbiting vane and an outer second compression chamber formed outside the orbiting vane, and the pair of vane side discharge holes comprise an outer vane side discharge hole positioned outside the orbiting vane and an inner vane side discharge hole positioned inside the orbiting vane.

5. The scroll compression of claim 4, wherein a diameter of the vane side suction hole is greater than that of each vane side discharge hole.

6. The scroll compressor of claim 4, wherein the vane side suction hole is positioned extendedly on the inner second compression chamber and the outer second compression chamber, and the outer vane side discharge hole is positioned extendedly on the outer second compression chamber and the inner vane side discharge hole is positioned extendedly on the inner second compression chamber.

7. The scroll compressor of claim 1, wherein the vane side suction hole is connected to a low pressure portion of the casing, and the vane side discharge hole is connected to a high pressure portion of the casing.

8. The scroll compressor of claim 1, wherein the slide block is installed to be in contact with an outer circumferential surface of the partition wall.

9. The scroll compressor of claim 1, wherein the boss portion is positioned at an outer circumferential surface of the rotary shaft centering on the rotary shaft, the partition wall is positioned at an outer edge of the boss portion, and the orbiting vane is positioned at an outer edge of the partition wall.

10. A scroll compressor comprising:

a frame fixedly installed inside a casing, for supporting a rotary shaft of a driving motor, wherein a ring-shaped partition wall protrudes from a bottom of a boss receiving portion formed at a central portion of the frame, a vane side suction hole is formed at one side of the bottom of the boss receiving portion outside the partition wall, and a pair of vane side discharge holes are formed at the other side of the bottom;

a fixed scroll fixedly installed at the frame and having a first suction hole at its outermost edge and a first discharge hole at its central portion;

an orbiting scroll having a boss portion for insertion of the rotary shaft and an orbiting vane encompassing the boss portion, wherein the boss portion is formed at a central portion of a lower portion of the orbiting scroll, and the orbiting vane is formed at an outer edge of the lower portion thereof and has a slit; and a slide block positioned between the vane side suction hole and the pair of vane side discharge holes, installed in the slit of the orbiting vane to be slidable in a radial direction of the frame, and forming a second compression chamber outside and inside the orbiting vane.

11. The scroll compressor of claim 10, wherein a slit is formed at the orbiting vane, and the slide block is slidably inserted in the slit.

12. The scroll compressor of claim 11, wherein curved portions are formed at both side surfaces of the slide block.

13. The scroll compressor of claim 10, wherein the second compression chamber comprises an inner second compression chamber formed inside the orbiting vane and an outer second compression chamber formed outside the orbiting vane, and the pair of vane side discharge holes comprise an outer vane side discharge hole positioned outside the orbiting vane and an inner vane side discharge hole positioned inside the orbiting vane.

14. The scroll compressor of claim 13, wherein a diameter of the vane side suction hole is greater than that of each vane side discharge hole.

15. The scroll compressor of claim 13, wherein the vane side suction hole is positioned extendedly on the inner second compression chamber and the outer second compression chamber, and the outer vane side discharge hole is positioned extendedly on the outer second compression chamber and the inner vane side discharge hole is positioned extendedly on the inner second compression chamber.

16. The scroll compressor of claim 13, wherein the vane side suction hole is connected to a low pressure portion of the casing, and the vane side discharge hole is connected to a high pressure portion of the casing.

17. The scroll compressor of claim 13, wherein the slide block is installed to be in contact with an outer circumferential surface of the partition wall.

18. The scroll compressor of claim 10, wherein the boss portion is positioned at an outer circumferential surface of the rotary shaft centering on the rotary shaft, the partition wall is positioned at an outer edge of the boss portion, and the orbiting vane is positioned at an outer edge of the partition wall.

19. A scroll compressor comprising:

a casing;

a driving motor fixedly installed in the casing, the driving motor having a rotary shaft;

a frame fixedly installed inside the casing to support the rotary shaft of the driving motor, the frame having a ring shaped partition wall protruding from a bottom of a boss receiving portion formed at a central portion of the frame, a vane side suction hole formed at one side of the bottom of the boss receiving portion outside the partition wall, and a pair of vane side discharge holes formed at the other side of the bottom;

a fixed scroll fixedly installed at the frame, the fixed scroll having a first suction hole at its outermost edge and a first discharge hole at its central portion;

an orbiting scroll having a boss portion for insertion of the rotary shaft, and an orbiting vane encompassing the boss portion, wherein the boss portion is formed at a central portion of a lower portion of the orbiting scroll and the orbiting vane is formed at an outer edge of the lower portion of the orbiting scroll at a certain interval from the boss portion; and a slide block positioned between the vane side suction hole and the pair of vane side discharge holes, the slide block being inserted in the orbiting vane to be slidable in a radial direction of the frame, and forming a second compression chamber outside and inside the orbiting vane.

* * * * *